US007152952B2

(12) United States Patent
Chikamoto

(10) Patent No.: US 7,152,952 B2
(45) Date of Patent: Dec. 26, 2006

(54) INK-JET HEAD AND METHOD OF MANUFACTURING THE SAME

(75) Inventor: Tadanobu Chikamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 231 days.

(21) Appl. No.: 10/874,255

(22) Filed: Jun. 24, 2004

(65) Prior Publication Data

US 2004/0263570 A1 Dec. 30, 2004

(30) Foreign Application Priority Data

Jun. 30, 2003 (JP) ..... 2003-188999

(51) Int. Cl.
*B41J 2/14* (2006.01)
*B41J 2/015* (2006.01)

(52) U.S. Cl. ..... 347/47; 347/20

(58) Field of Classification Search ..... 347/20, 347/45, 47, 54, 71
See application file for complete search history.

(56) References Cited

U.S. PATENT DOCUMENTS 6,536,879 B1 * 3/2003 Ito et al. ..... 347/71
2002/0042994 A1 4/2002 Ito et al.
2004/0104954 A1 6/2004 Ito

FOREIGN PATENT DOCUMENTS

JP A 8-174825 7/1996
JP A 2003-039656 2/2003
JP A 2003-053980 2/2003

* cited by examiner

*Primary Examiner*—An H. Do
(74) *Attorney, Agent, or Firm*—Oliff & Berridge, PLC

(57) ABSTRACT

An ink-jet head includes a nozzle plate in which a nozzle positioning hole is formed, a front end in which a cover plate and a cavity plate provided with a first and a second positioning holes are disposed at both ends, and a reservoir in which a reservoir positioning plate provided with a reservoir positioning hole is disposed at one end. In method of the manufacturing of the ink-jet head, a first positioning pin is fitted in the nozzle positioning hole and the first positioning hole. The nozzle plate and the front end are positioned and are bonded. Then, a second positioning pin inserted through the first positioning hole and the nozzle positioning hole is fitted in the second positioning hole and the reservoir positioning hole, and the front end and the reservoir are positioned and are bonded.

7 Claims, 9 Drawing Sheets

INK-JET HEAD AND METHOD OF MANUFACTURING THE SAME

BACKGROUND OF THE INVENTION

1. Filed of the Invention

The present invention relates to an ink-jet head provided in a printer or the like and a method of manufacturing the same.

2. Description of the Related Art

An ink-jet head used for a printer, a facsimile or the like includes a front end as a flow path unit in which thin plates are laminated and an ink flow path is formed. A nozzle plate in which plural nozzles for discharging ink are arranged is bonded to one surface of the front end. A reservoir is provided on the other surface of the front end, and supports and reinforces the thin front end.

JP-A-8-174825 (pages 2 to 4, FIG. 7) discloses a method of bonding a front end and a nozzle plate. Through holes are formed in plural thin plates constituting the front end and the nozzle plate. A positioning pin is fitted in the through holes, and the respective layers are laminated through adhesive, so that the front end and the nozzle plate are positioned and are bonded. By this, a nozzle is disposed at a specified position with respect to an ink flow path.

The position accuracy of the nozzle with respect to the ink flow path has a great influence on a discharge characteristic, and in order to ensure high discharge accuracy, it is necessary to position the front end and the nozzle plate with high accuracy. Thus, a method is conceivable in which after the respective layers of the front end are previously bonded to each other, the front end and the nozzle plate are positioned and are bonded.

FIGS. 13 and 14 are sectional views showing a manufacture process of an ink-jet head. A first and a second positioning holes 76*b* and 76*c* and through holes 76*a* and 76*d* are formed in a front end 76. The through hole 76*d* is provided coaxially with the second positioning hole 76*c*, and its diameter is larger than that of the second positioning hole 76*c*.

A nozzle positioning hole 29*a* and a through hole 29*b* are formed in a nozzle plate 29. The diameter of the through hole 29*b* is larger than that of the second positioning hole 76*c*. In the front end 76, a positioning pin (not shown) is fitted in the through hole 76*a* so that respective thin plates are positioned, and the respective layers are previously bonded to each other.

A positioning pin 91 is fitted in the first positioning hole 76*b* and the nozzle positioning hole 29*a*, and the front end 76 and the nozzle plate 29 are positioned and are bonded to each other. By this, a flow path unit 2 is formed and a nozzle (not shown) is positioned with high accuracy with respect to an ink flow path (not shown).

Next, as shown in FIG. 14, a reservoir 75 is formed by laminating thick plates, and a through hole 75*a* and a reservoir positioning hole 75*b* are formed. In the reservoir 75, a positioning pin (not shown) is fitted in the through hole 75*a* so that the respective thick plates are positioned and the respective layers are previously bonded to each other.

A positioning pin 92 is fitted in the second positioning hole 76*c* and the reservoir positioning hole 75*b* through the through holes 29*b* and 76*d*, and the front end 76 and the reservoir 75 are positioned and are bonded. By this, the nozzle plate 29, the front end 76 and the reservoir 75 are formed as one body.

SUMMARY OF THE INVENTION

However, according to the above conventional ink-jet head, the first and the second positioning holes 76*b* and 76*c* are formed side by side in the radial direction in the front end 76. Thus, there has been a problem that the ink-jet head becomes long in the longitudinal direction (horizontal direction in FIG. 14) and the ink-jet head becomes large.

The present invention provides an ink-jet head which can be miniaturized. Besides, the invention to provides a method of manufacturing an ink-jet head in which the ink-jet head can be miniaturized.

According to first aspect of the invention, a method of manufacturing an ink-jet head constructed by laminating a nozzle plate having a nozzle for discharging ink, a front end provided with a flow path for supplying the ink to the nozzle, and a reservoir for strengthening the front end, the method including the steps of; forming the nozzle plate having a nozzle positioning hole; forming the front end by positioning and laminating plural thin plates including a first thin plate having a first positioning hole and a second thin plate having a second positioning hole communicating with the first positioning hole and smaller than the first positioning hole, so that the first thin plate and the second thin plate are respectively positioned at ends in a lamination direction; forming the reservoir by positioning and laminating plural plates including a reservoir positioning plate having a reservoir positioning hole, so that the reservoir positioning plate is positioned at an end in the lamination direction; positioning the nozzle plate and the front end by inserting a first positioning pin from a side of the nozzle plate through the nozzle positioning hole and the first positioning hole in a first state where the nozzle plate and the first thin plate face each other; joining the nozzle plate and the front end in the first state; positioning the front end and the reservoir by inserting a second positioning pin through the second positioning hole and the reservoir positioning hole from the side of the nozzle plate through the nozzle positioning hole and the first positioning hole in a second state where the second thin plate and the reservoir positioning plate face each other; and joining the front end and the reservoir in the second state.

According to second aspect of the invention, an ink-jet head including: a nozzle plate including a nozzle which discharges ink and a nozzle positioning hole; a front end provided with a flow path which supplies the ink to the nozzle, the front end including plural thin laminated plates having; a first thin plate, in which a first positioning hole is formed, and positioned at one end of the front end in a lamination direction; and a second thin plate, in which a second positioning hole communicating with the first positioning hole is formed, and positioned at the other end of the front end in the lamination direction; and a reservoir strengthening the front end and including one or more thick plates in which a reservoir positioning hole is formed, wherein the nozzle plate, the font end, and the reservoir are sequentially positioned and are laminated, a first positioning pin, which positions the nozzle plate and the front end, is inserted into the nozzle positioning hole and the first positioning hole, and a second positioning pin, which positions the front end and the reservoir, is inserted into the second positioning hole and the reservoir positioning hole.

According to the above aspects, the first positioning pin is fitted in the nozzle positioning hole and the first positioning hole, and the nozzle plate and the front end are positioned and are bonded. Besides, the second positioning pin inserted through the first positioning hole communicating with the second positioning hole and the nozzle positioning hole is fitted in the second positioning hole and the reservoir positioning hole, and the front end and the reservoir are positioned and are bonded. Accordingly, the four holes, that is, the nozzle positioning hole and the first positioning hole for positioning the nozzle plate and the front end, and the second positioning hole and the reservoir positioning hole for positioning the front end and the reservoir can be disposed to communicate with each other in the lamination direction of the nozzle plate, the front end, and the reservoir, so that these four holes for lamination positioning can be intensively disposed, and by this, the ink-jet head can be miniaturized.

Besides, in the ink-jet head of the above structure, the second positioning pin which passes through the nozzle positioning hole and the first positioning hole is inserted into the second positioning hole and the reservoir positioning hole.

Besides, in the ink-jet head of the above structure, the first positioning hole has a diameter larger than that of the second positioning hole.

According to the structure, when the second positioning pin inserted through the first positioning hole is fitted in the second positioning hole, the interference between the first thin plate and the second position pin is prevented, and the second positioning pin can be smoothly inserted.

Besides, each thin plate of the plural thin laminated plates positioned between the first and the second thin plates of the front end has a through hole communicating the first positioning hole with the second positioning hole. The each thin plate has a diameter larger than those of the first and the second positioning holes.

According to the structure, when the second positioning pin inserted through the first positioning hole is fitted in the second positioning hole, the interference between each of the thin plates disposed between the first and the second thin plates and the second positioning pin is prevented, and the second positioning pin can be smoothly inserted. Besides, when the first positioning pin is fitted in the first positioning hole, the interference between the thin plate adjacent to the first thin plate and the first positioning pin is prevented. Accordingly, reduction in positioning accuracy can be prevented.

Besides, a piezoelectric element is fixed to the front end. The reservoir has a recess which avoids interference with the piezoelectric element.

According to the structure, the piezoelectric element is disposed in a space between the recess of the reservoir and the front end, and the front end and the reservoir can be easily joined.

Besides, the front end includes third positioning hole, through which each of the plural thin laminated plates is inserted, at position which is different from the first and the second positioning holes.

According to the structure, in the front end, the positioning pin is fitted in the third positioning hole, and the respective thin plates are laminated and are bonded. By this, the front end is easily formed in advance, and the front end and the nozzle plate can be bonded with high positioning accuracy.

Besides, the reservoir includes plural laminated thick plates.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Hereinafter, embodiments of the invention will be described with reference to the drawings.

Figure 1:
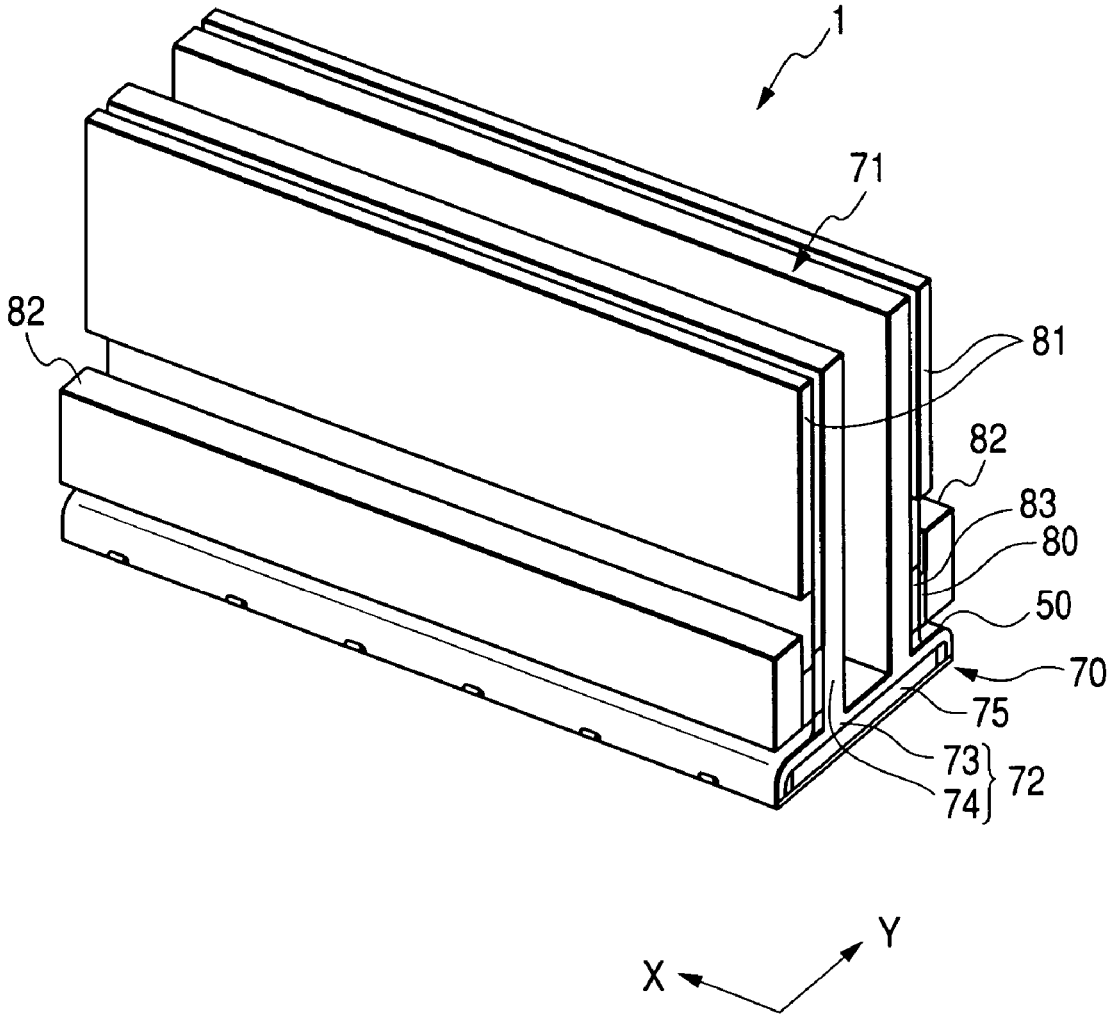
FIG. 1 is a perspective view of an ink-jet head of an embodiment of the invention.

FIG. 1 is a perspective view showing an ink-jet head of an embodiment. In an ink-jet bead 1, a head unit 70 disposed to be opposite to a recording sheet is held by a base part 71. The ink-jet head 1 is scanned in an X direction (main scanning direction), and the recording sheet is transported in a Y direction (sub-scanning direction), so that recording can be performed on the recording sheet.

As described later in detail, the head unit 70 includes a flow path unit 2 in which a flow path including a pressure chamber 10, a nozzle 8 and the like is constructed, and an actuator unit 4 for pressurizing ink in the pressure chamber 10 (see FIGS. 2 and 4), and discharges the ink to a specified position of the recording sheet. The base part 71 includes a reservoir 75 and a holder 72. The reservoir 75 is fixed to the back side of the head unit 70, and supports the head unit 70 formed to be thin and reinforces its strength.

The holder 72 includes a main body part 73 and a support part 74. The main body part 73 holds the reservoir 75. The support part 74 is provided to extend from the main body part 73 in the opposite direction to the head unit 70, and the ink-jet head 1 is supported by the support part 74.

An FPC 50 connected to an individual electrode 6 (see FIG. 5) forming an actuator is disposed on the outer periphery of the base part 71 through an elastic member 83 such as a sponge. A driver IC 80 for driving the actuator and a control board 81 for controlling the driver XC 80 are attached to the FPC 50. A heat sink 82 for dissipating heat generation is fixed to the driver IC 80.

Figure 2:
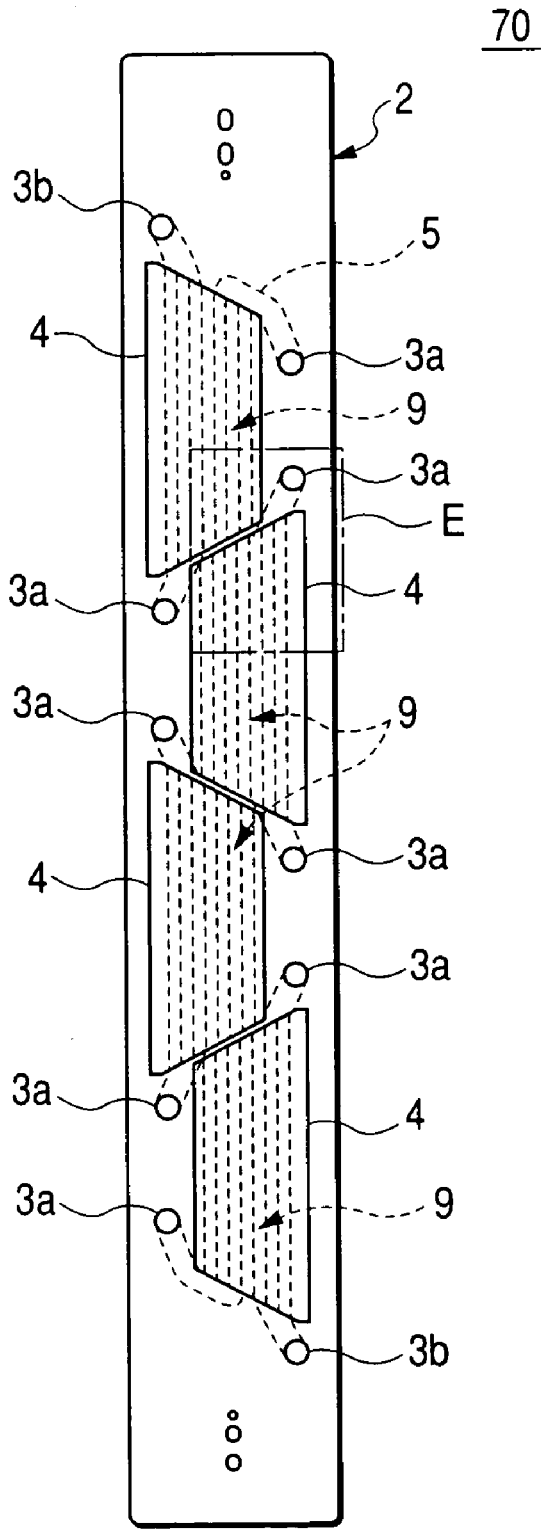
FIG. 2 is a plan view of a head unit of the ink-jet head of the embodiment of the invention.

FIG. 2 is a plan view showing the head unit 70. The head unit 70 includes the flow path unit 2 for forming the ink flow path. The flow path unit 2 is formed to be rectangular, and includes plural discharge element groups 9 disposed in two lines side by side in a long side direction, while they are overlapped in a short side direction.

The actuator unit 4 including the actuators made of piezoelectric elements is fixed onto each of the discharge element groups 9. Besides, ink is supplied to each of the discharge element groups 9 from a manifold 5 communicating with an ink pool (not shown) provided in the reservoir 75 (see FIG. 1) through an opening part 3*a*, 3*b*.

Figure 3:
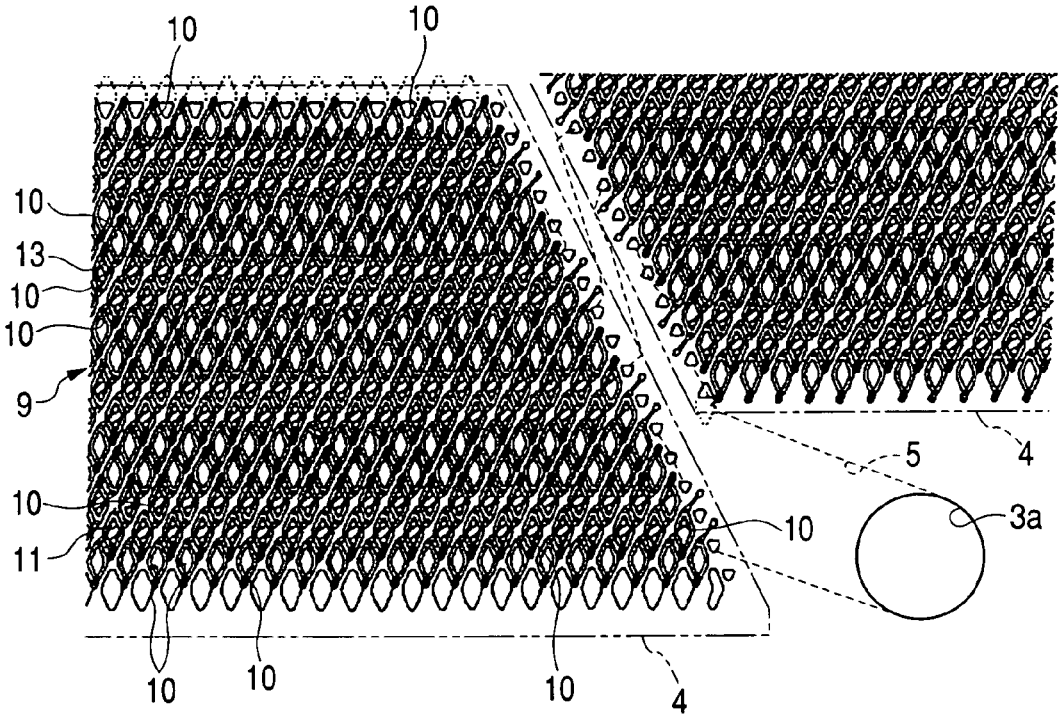
FIG. 3 is a detailed view of a part E of FIG. 2.

FIG. 3 is a plan view showing the details of a part E of FIG. 2. Each of the discharge element groups 9 is constructed such that many discharge elements 11 for discharging ink are disposed in a matrix form correspondingly to respective pixels of a recording image, and its outer shape is substantially trapezoidal. Each of the discharge elements 11 includes an aperture 13 communicating with the manifold 5, a pressure chamber 10, a nozzle 8 (see FIG. 4) and the like.

Figure 4:
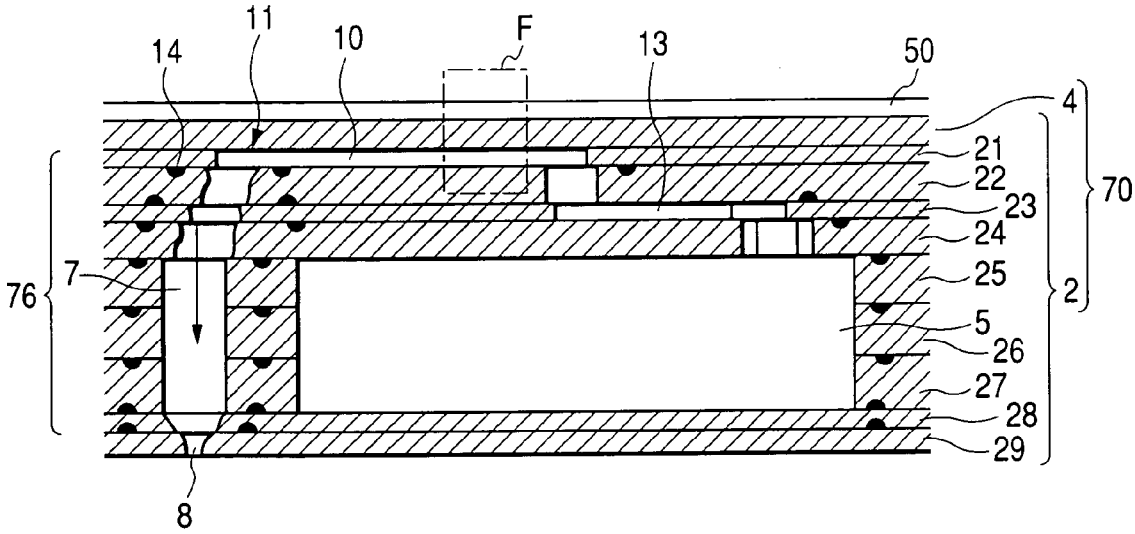
FIG. 4 is a sectional view showing a discharge element of the ink-jet head of the embodiment of the invention.

FIG. 4 shows a sectional shape of the discharge element 11. The flow path unit 2 is constructed by laminating thin plates of Ni or the like, and is formed such that a front end 76 and a nozzle plate 29 are bonded to each other. The front end 76 includes a cavity plate 21, a base plate 22, an aperture plate 23, a supply plate 24, manifold plates 25, 26, and 27, and a cover plate 28 in sequence from the side of the actuator unit 4, and is constructed by laminating them in this sequence. This front end 76 constitutes the flow path unit for supplying ink to the nozzle 8.

The pressure chamber 10 is formed in the cavity plate 21. The pressure chamber 10 pressure-feeds the ink sucked from the manifold 5 to the nozzle 8 by driving of the aftermentioned actuator. The aperture 13 and a through hole constituting an ink delivery path 7 are formed in the aperture plate 23. The flow path of the ink flowing into the pressure chamber 10 from the manifold 5 is narrowed by the aperture 13. A through hole for communicating the aperture 13 with the pressure chamber 10 and a through hole constituting the ink delivery path 7 are formed in the base plate 22.

The manifold plates 25, 26 and 27 are laminated to form the manifold 5, and a through hole constituting the ink delivery path 7 is formed. A through hole for communicating the aperture 13 with the manifold 5 and a through hole constituting the ink delivery path 7 are formed in the supply plate 24.

The nozzle 8 for discharging the ink sent through the ink delivery path 7 is formed in the nozzle plate 29. An opening part constituting the ink delivery path 7 and for supplying the ink to the nozzle 8 is formed in the cover plate 28. The respective plates (21 to 29) are laminated, so that the flow path unit 2 is formed which includes the plural discharge elements 11 each communicating with the nozzle 8 through the pressure chamber 10 from the outlet of the manifold 5 functioning as a common ink chamber. Incidentally, reference numeral 14 designates release grooves for releasing adhesive for bonding the respective layers.

Figure 5:
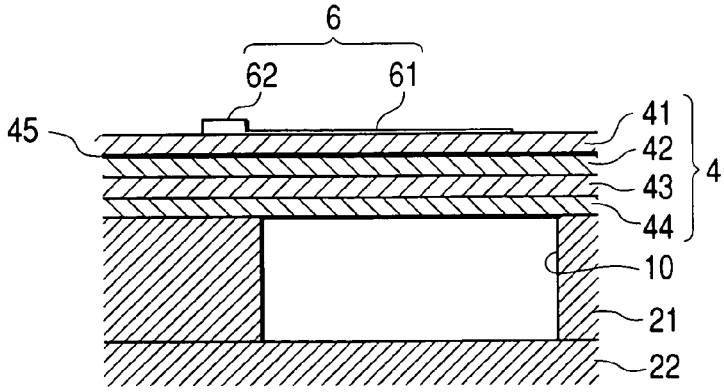
FIG. 5 is a sectional view showing an actuator constituting an actuator unit of the ink-jet head of the embodiment of the invention.

FIG. 5 shows a part F of FIG. 4, and is a sectional view showing the details of an individual actuator constituting the actuator unit 4. In the actuator unit 4, plural piezoelectric sheets 41 to 44, together with an internal electrode 45, are laminated. At the side away from the flow path unit 2 side, the individual electrode 6 is provided to be opposite to the pressure chamber 10 of each of the discharge elements 11.

Figure 6:
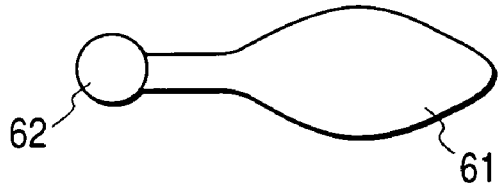
FIG. 6 is a plan view showing an individual electrode of the actuator unit of the ink-jet head of the embodiment of the invention.

As shown in FIG. 6, the individual electrode 6 includes a land part 62 and an electrode part 61, and the electrode part 61 is formed to have a substantially rhombic plain shape approximate to that of the pressure chamber 10. By this, the actuator formed of the piezoelectric element corresponding to each of the discharge elements 11 is constructed. When voltage is applied to the individual electrode 6, the actuator is deformed, so that the volume of the pressure chamber 10 (see FIG. 4) is changed, and the suction and pressure feed of ink is enabled.

Figure 7:
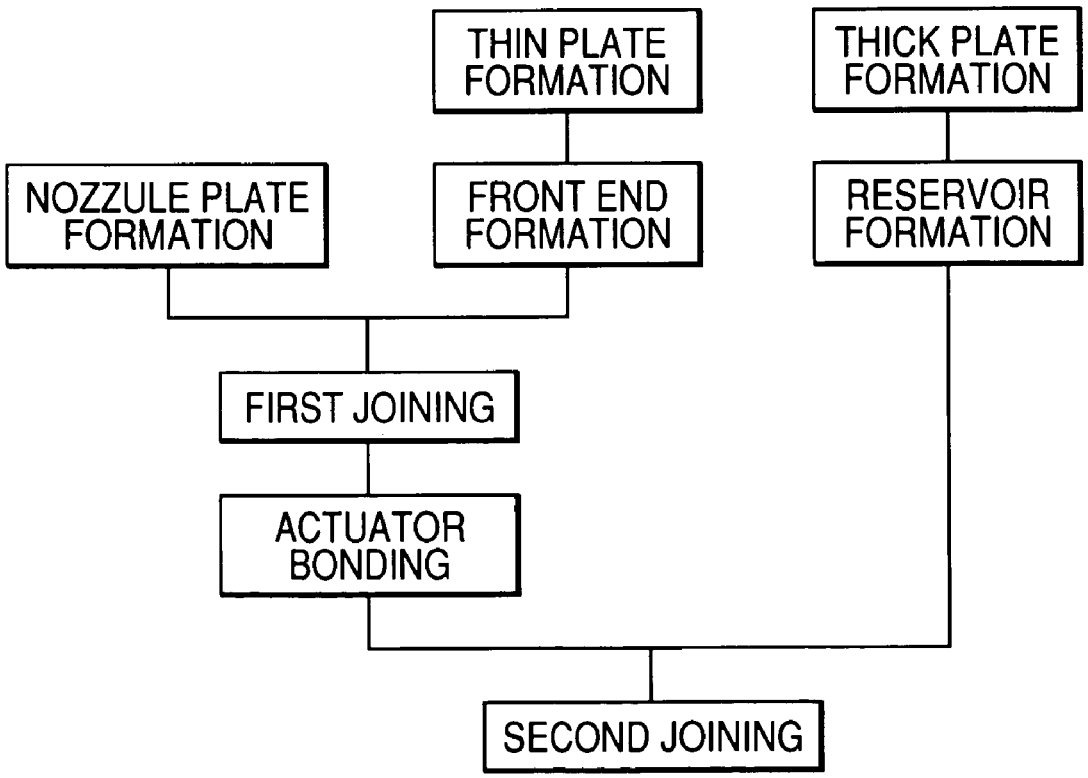
FIG. 7 is a process view showing a manufacture process of the ink-jet head of the embodiment of the invention.

FIG. 7 is a process view showing a manufacture process of unifying the head unit 70 of the ink-jet head 1 and the reservoir 75. In a nozzle plate formation process, the nozzle plate 29 including a nozzle positioning hole 29*a* (see FIG. 10) and the nozzle 8 is formed by etching and press working.

Figure 8:
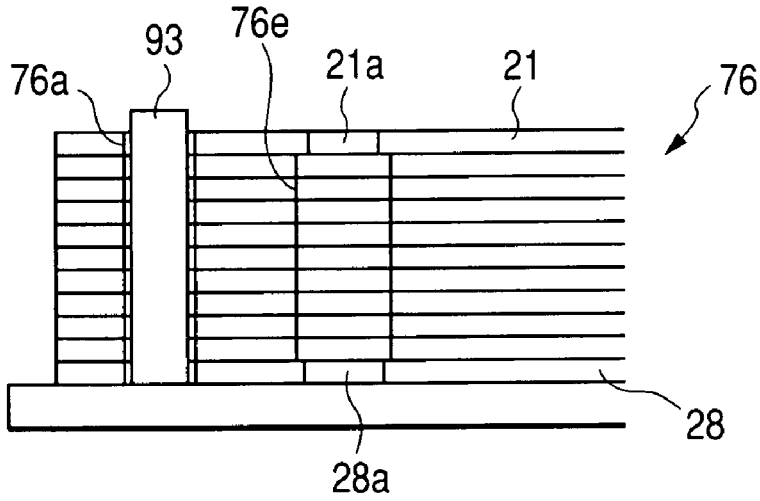
FIG. 8 is a sectional view showing a front end formation process of the ink-jet head of the embodiment of the invention.

In a thin plate formation process, the respective thin plates of the front end 76 including the respective through holes for the ink flow path and for positioning are formed by etching. In front end formation working, as shown in FIG. 8, the respective thin plates of the front end 76 are laminated. Through holes 76*a* (third positioning hole) having the same diameter are formed in the respective thin plates by the thin plate formation process. A positioning pin 93 is fitted in the through holes 76*a*, and the respective thin plates are positioned and are bonded.

Figure 9:
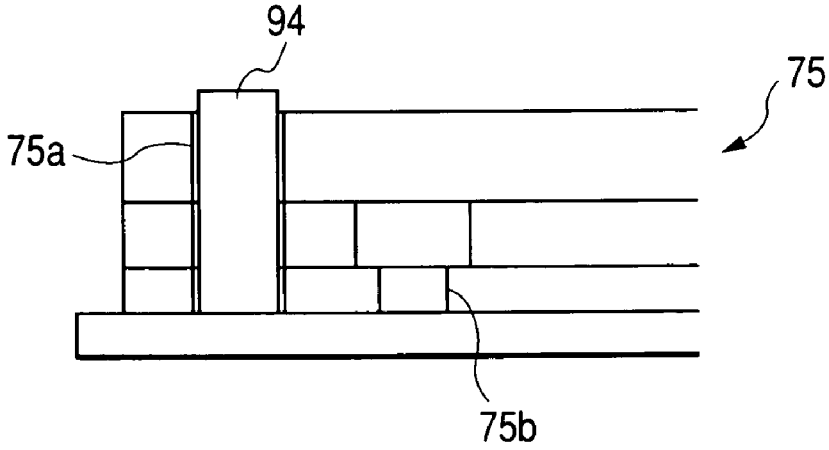
FIG. 9 is a sectional view showing a reservoir formation process of the ink-jet head of the embodiment of the invention.

In a thick plate formation process, respective thick plates of the reservoir 75 having an ink pool (not shown) and the like are formed by etching and press working. In reservoir formation working, as shown in FIG. 9, the respective thick plates of the reservoir 75 are laminated. Positioning holes 75*a* having the same diameter are formed in the respective thick plates by the thick plate formation process. A positioning pin 94 is fitted in the through holes 75*a*, and the respective thick plates are positioned and are bonded.

Figure 10:
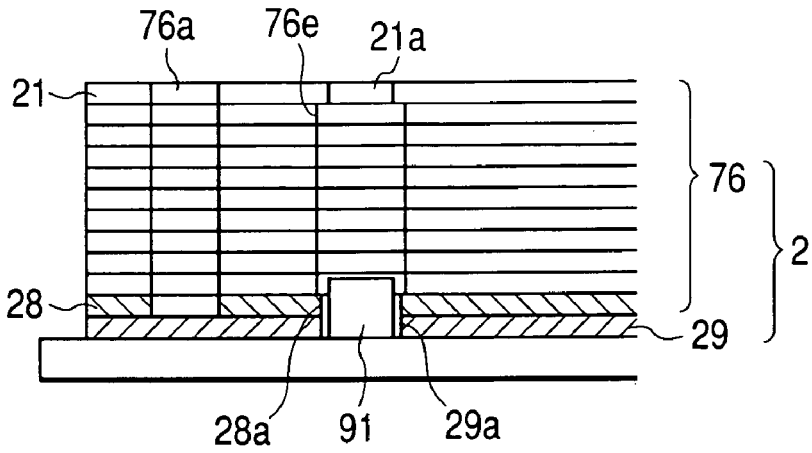
FIG. 10 is a sectional view showing a first joining process of the ink-jet head of the embodiment of the invention.

In a first joining process, as shown in FIG. 10, the nozzle plate 29 and the front end 76 are bonded and the flow path unit 2 is formed. The nozzle positioning hole 29*a* is formed in the nozzle plate 29 by the nozzle plate formation process. A first positioning hole 28*a* having the same diameter as the nozzle positioning hole 29*a* is formed in the cover plate 28 disposed at one end of the front end 76 in the lamination direction by the thin plate formation process.

Incidentally, a second positioning hole 21*a* having a diameter smaller than that of the nozzle positioning hole 29*a* is formed in the cavity plate 21 disposed at the other end of the front end 76 in the lamination direction by the thin plate formation process. A through hole 76*e* having a diameter further larger than that of the nozzle positioning hole 29*a* is formed in each of the thin plates disposed between the cover plate 28 and the cavity plate 21 by the thin plate formation process.

A positioning pin 91 (first positioning pin) is fitted in the nozzle positioning hole 29*a* and the positioning hole 28*a*, and the front end 76 and the nozzle plate 29 are positioned and are bonded. By this, the nozzle 8 is disposed with high accuracy with respect to the ink flow path formed in the front end, and high discharge accuracy can be obtained.

Incidentally, since the through hole 76*e* has the diameter larger than the positioning hole 28*a*, it is possible to position the front end 76 and the nozzle plate 29 without interference between the through hole 76*e* and the positioning pin 91.

In an actuator bonding process, the actuator unit 4 is bonded to the flow path unit 2 so that the head unit 70 is formed. As shown in FIG. 2, the plural actuator units 4 are provide in correspondence to the respective discharge element groups 9.

Figure 11:
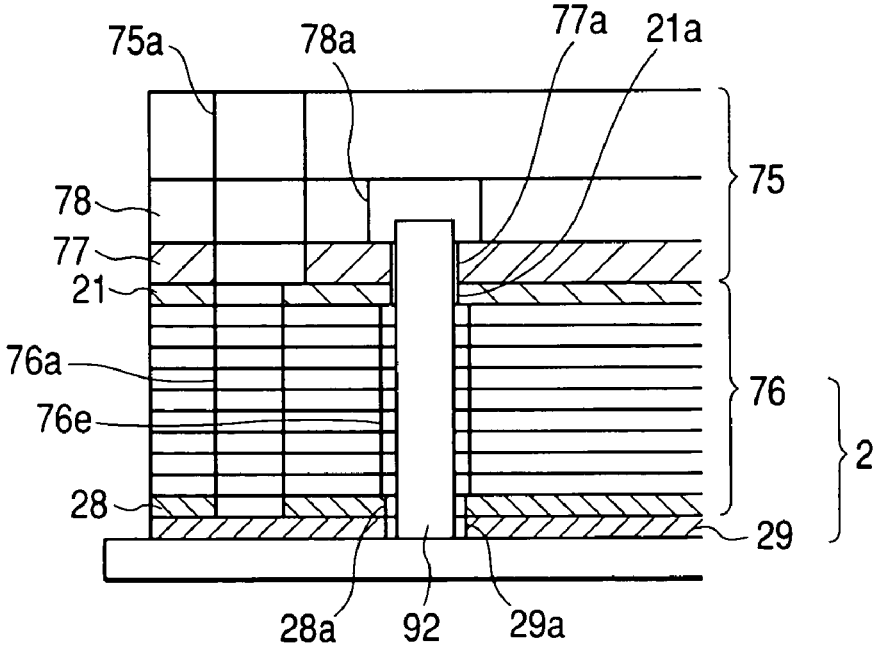
FIG. 11 is a sectional view showing a second joining process of the ink-jet head of the embodiment of the invention.

In a second joining process, as shown in FIG. 11, the front end 76 of the head unit 70 and the reservoir 75 are bonded. A reservoir positioning hole 77*a* having the same diameter as that of the second positioning hole 21*a* of the cavity plate 21 is formed in a reservoir positioning plate 77 disposed at one end of the reservoir 75 in the lamination direction by the thick plate formation process. Besides a through hole 78*a* having a diameter larger than that of the reservoir positioning hole 77*a* is formed in a thick plate 78 adjacent to the reservoir positioning plate 77 by the thick plate formation process.

Figure 12:
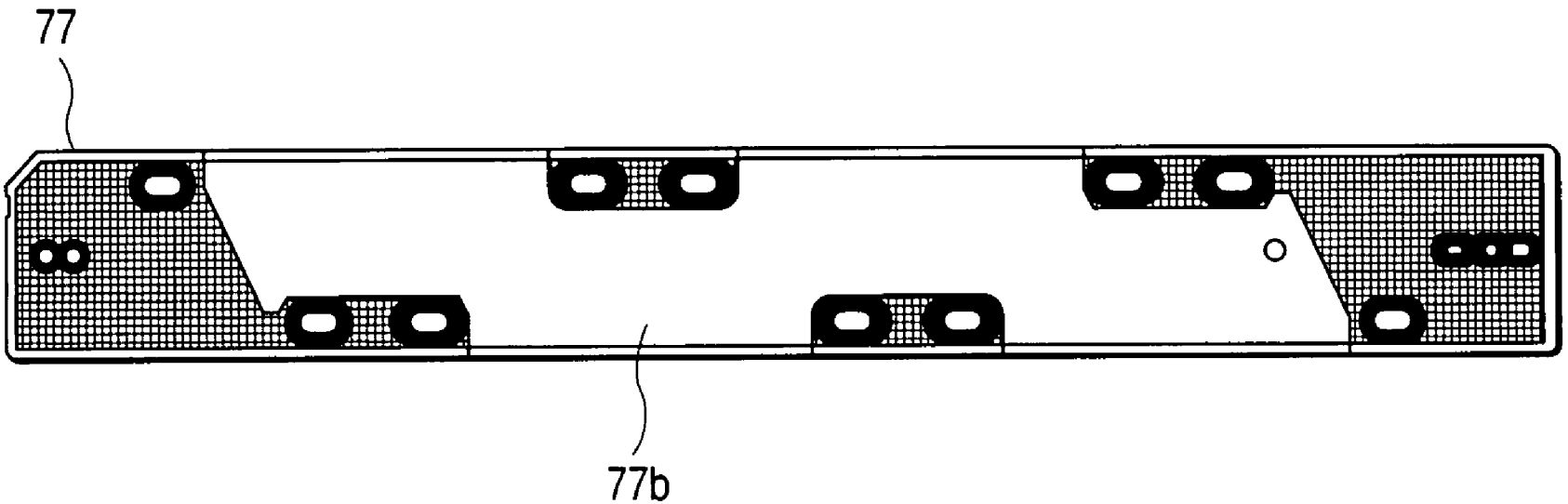
FIG. 12 is a plan view showing a reservoir positioning plate of the ink-jet head of the embodiment of the invention.
Figure 13:
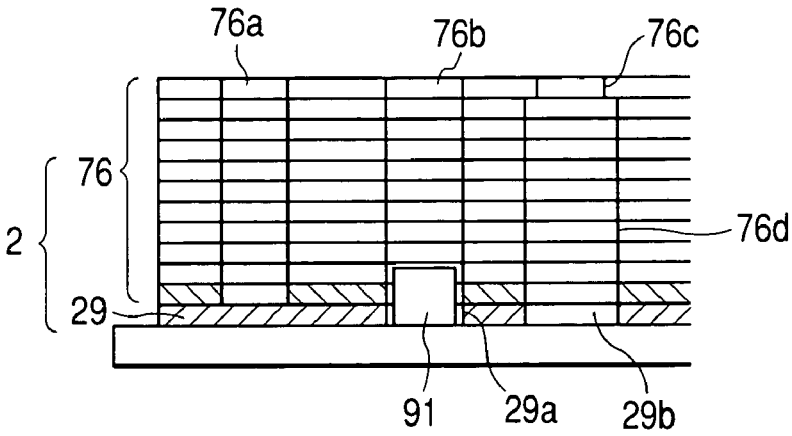
FIG. 13 is a sectional view showing a manufacture process of a conventional ink-jet head.
Figure 14:
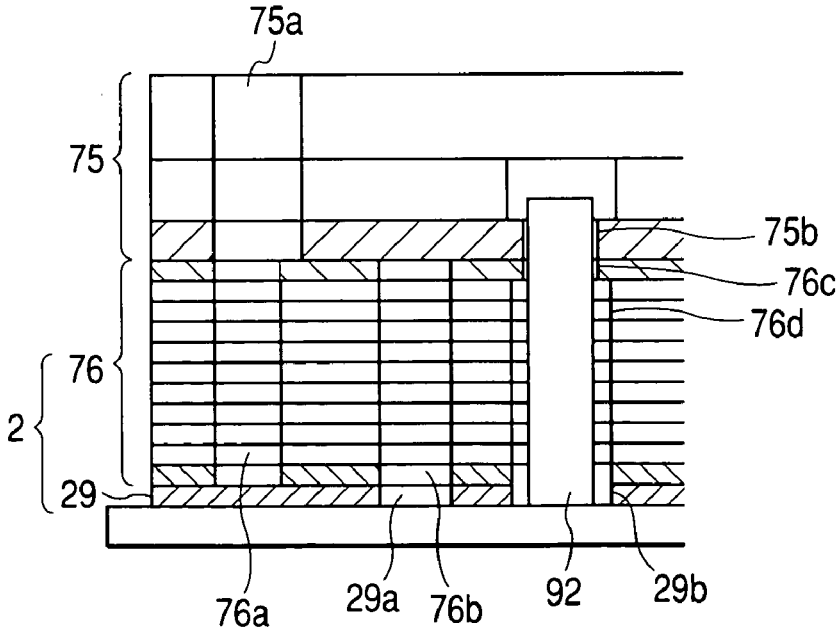
FIG. 14 is a sectional view showing the manufacture process of the conventional ink-jet head.

A positioning pin 92 (second positioning pin) is fitted in the reservoir positioning hole 77*a* and the second positioning hole 21*a*, and the reservoir 75 and the front end 76 are positioned and are bonded. FIG. 12 shows a surface of the reservoir positioning plate 77 as the lower layer of the reservoir 75 at the side of the front end 76. As shown in the drawing, a recess 77*b* is formed in the reservoir positioning plate 77 at a position corresponding to the actuator unit 4. The interference between the reservoir 75 and the actuator unit 4 is avoided by the recess 77*b*, and the reservoir 75 and the front end 76 can be pressed to each other.

Since the nozzle positioning hole 28*a*, the first positioning hole 29*a* and the through hole 76*e* have the diameters larger than that of the second positioning hole 21*a*, the positioning pin 92 passes through these, and can be fitted in the reservoir positioning hole 77*a* and the positioning hole 21*a*. Thus, the through holes through which the positioning pins 91 and 92 are inserted are not required to be provided side by side.

Accordingly, the ink-jet head 1 can be made short in the longitudinal direction (horizontal direction in FIG. 11), and the ink-jet head 1 can be miniaturized. As long as the positioning pin 92 can be inserted through the nozzle positioning hole 28*a*, the first positioning hole 29*a* and the through hole 76*e*, they may not be coaxial with the second positioning hole 21*a*.

Incidentally, the reservoir positioning plate 77 is partially made thin by the formation of the recess 77*b* (see FIG. 12), and external force is not directly applied to the piezoelectric element after the assembly. Thus, in an assembly procedure, when bonding is performed while positioning is made in a state where the front end 76 to which the piezoelectric element is fixed is pressed to the reservoir 75, because of the low rigidity of the front end 76, the piezoelectric element comes in contact with the reservoir 75 during the bonding, and unnecessary external force is applied.

However, in this embodiment, as described above, bonding is performed in a state where the reservoir 75 is pressed to the front end 76 assembled with high position accuracy by the nozzle positioning hole 28*a* and the first positioning hole 29*a*. This reservoir 75 itself has high rigidity, and is not deformed by pressing. Further, bonding of the front end 76 and the nozzle plate 29 is performed before the front end 76 and the reservoir 75 are bonded, so that the number of times the pressing force is applied to the piezoelectric element is made minimum.

The method of manufacturing the ink-jet head according to the invention includes the first joining step of positioning the nozzle plate and the front end by inserting the first positioning pin from the side of the nozzle plate through the nozzle positioning hole and the first positioning hole in the state where the nozzle plate and the first thin plate face each other, and joining the nozzle plate and the front end in that state, and the second joining step of positioning the front end and the reservoir by inserting the second positioning pin through the second positioning hole and the reservoir positioning hole from the side of the nozzle plate through the nozzle positioning hole and the first positioning hole in the state where the second thin plate and the reservoir positioning plate face each other, and joining the front end and the reservoir in that state. Accordingly, the nozzle plate and the front end can be joined before the front end and the reservoir are joined, and the ink-jet head can be miniaturized.

Besides, according to the ink-jet head of the invention, the nozzle positioning hole and the first positioning hole for positioning the nozzle plate and the front end are respectively provided in the nozzle plate and the front end, the second positioning hole and the reservoir positioning hole for positioning the front end and the reservoir are respective provided in the front end and the reservoir, and the first and the second positioning holes are communicated with each other, that these holes can be intensively disposed in the partial areas of the nozzle plate, the front end, and the reservoir in the longitudinal direction. Accordingly, the length of the nozzle plate, the front end and the reservoir plate in the longitudinal direction can be made short, and the ink-jet head can be miniaturized.

What is claimed is:

1. A method of manufacturing an ink-jet head constructed by laminating a nozzle plate having a nozzle for discharging ink, a front end provided with a flow path for supplying the ink to the nozzle, and a reservoir for strengthening the front end, the method comprising the steps of:

forming the nozzle plate having a nozzle positioning hole;

forming the front end by positioning and laminating plural thin plates including a first thin plate having a first positioning hole and a second thin plate having a second positioning hole communicating with the first positioning hole and smaller than the first positioning hole, so that the first thin plate and the second thin plate are respectively positioned at ends in a lamination direction;

forming the reservoir by positioning and laminating plural plates including a reservoir positioning plate having a reservoir positioning hole, so that the reservoir positioning plate is positioned at an end in the lamination direction;

positioning the nozzle plate and the front end by inserting a first positioning pin from a side of the nozzle plate through the nozzle positioning hole and the first positioning hole in a first state where the nozzle plate and the first thin plate face each other;

joining the nozzle plate and the front end in the first state;

positioning the front end and the reservoir by inserting a second positioning pin after having removed the first positioning pin, through the second positioning hole and the reservoir positioning hole from the side of the nozzle plate through the nozzle positioning hole and the first positioning hole in a second state where the second thin plate and the reservoir positioning plate face each other; and joining the front end and the reservoir in the second state.

2. The method of manufacturing an ink-jet head according to claim 1, wherein the nozzle plate and the front end are joined in the first state before the front end and the reservoir are joined in the second state.

3. An ink-jet head comprising:

a nozzle plate including a nozzle which discharges ink and a nozzle positioning hole;

a front end provided with a flow path which supplies the ink to the nozzle, the front end including plural thin laminated plates having:

a first thin plate, in which a first positioning hole is formed, and positioned at one end of the front end in a lamination direction, the first positioning hole being aligned with and communicated with the nozzle positioning hole; and a second thin plate, in which a second positioning hole communicating with the first positioning hole is formed, and positioned at the other end of the front end in the lamination direction; and a reservoir strengthening the front end and including one or more thick plates in which a reservoir positioning hole is formed, wherein:

the nozzle plate, the front end, and the reservoir are sequentially positioned and are laminated;

a first positioning pin, which positions the nozzle plate and the front end, is inserted into the nozzle positioning hole and the first positioning hole;

a second positioning pin, which positions the front end and the reservoir and which passes through the nozzle positioning hole and the first positioning hole, is inserted into the second positioning hole and the reservoir positioning hole; and the first positioning hole has a diameter larger than that of the second positioning hole.

4. The ink-jet head according to claim 3, wherein each thin plate of the plural thin laminated plates positioned between the first and the second thin plates of the front end has a through hole communicating the first positioning hole with the second positioning hole, and the each thin plate has a diameter larger than those of the first and the second positioning holes.

5. The ink-jet head according to claim 3, wherein a piezoelectric element is fixed to the front end, and the reservoir has a recess which avoids interference with the piezoelectric element.

6. The ink-jet head according to claim 3, wherein the front end includes a third positioning hole, formed through each of the plural thin laminated plates, at a position which is different from the first and the second positioning holes.

7. The ink-jet head according to claim 3, wherein the reservoir includes plural laminated thick plates.

* * * * *